US005816835A

United States Patent [19]

Meszaros

[11] Patent Number: 5,816,835

[45] Date of Patent: Oct. 6, 1998

[54] MULTI-SLEEVE HIGH-VOLTAGE CABLE PLUG WITH VENTED SEAL

[75] Inventor: James R. Meszaros, Middleboro, Mass.

[73] Assignee: Alden Products Company, Brockton, Mass.

[21] Appl. No.: 731,855

[22] Filed: Oct. 21, 1996

[51] Int. Cl.[6] ..... H01R 4/60

[52] U.S. Cl. ..... 439/205

[58] Field of Search ..... 439/205, 206, 439/934, 181

[56] References Cited

U.S. PATENT DOCUMENTS 3,953,099 4/1976 Wilson ..... 439/205

4,553,807 11/1985 Cane ..... 439/206

*Primary Examiner*—Hien Vu

*Assistant Examiner*—Yong Ki Kim

*Attorney, Agent, or Firm*—Donald W. Meeker

[57] ABSTRACT

An outer cable plug sleeve has a sealing ridge with a notch in it to allow interfacial air to escape during insertion and enter during extraction of the cable plug. A cable plug receptacle has a mating sealing groove which receives the sealing ridge covering the notch. A series of mutually engaging overlapping sleeves creates multiple air seals and a long path between an internal pin/contact electrical connection and an external shield plate ground on the plug. A split metal coupling nut slips over the cable and engages the shield plate and screws onto a threaded receptacle cylinder securing the previously coupled cable plug and receptacle together.

15 Claims, 2 Drawing Sheets

MULTI-SLEEVE HIGH-VOLTAGE CABLE PLUG WITH VENTED SEAL

BACKGROUND OF THE INVENTION

1. Technical Field

The present invention relates to high voltage cable plugs and in particular to a high-voltage cable plug having a series of interlocking sleeves creating a series of seals and a long path between contact and ground and a sealing bead with a notch on interior of the outermost sleeve acting as a vent for exhausting air during connection and inletting air during disconnection, and a groove creating a seal with the bead for sealing the bead and notch after full connection of the plug.

2. Description of the Prior Art

In high voltage cable plug connections it is important to eliminate air from inside the cable plug connection to prevent ionizing of the air and prevent arcing between the contact and the ground and to make insertion and extraction of the plug easier. After connection of the cable plug it is important to seal the connection and prevent air from entering. Another factor in eliminating arcing is to make the length of the path between the contact and the ground long, so that even if some air were present arcing would be prevented.

Prior art attempts to eliminate air from high voltage connections have varied in complexity and difficulty of operation. U.S. Pat. No. 5,316,492 provides a plug-in connection for high-voltage plastic cable which utilizes a tube or wire inserted in the connection for releasing air via the tube or air space around the wire when the connection is plugged together and then removing the tube or wire after making the connection. The removal would seem difficult in a tight connection and still might provide the opportunity for air to enter during removal.

U.S. Pat. No. 5,358,420 discloses a pressure relief for an electrical connector having a flexible interface seal which bends to release air and a feathered pressure release slot on one of the connector members to release air during mating of two connector members for a printed circuit board and then compress the seal to close off the connector to air. There would appear to be increased tension created by forcing the seal to compress and therefore make it more difficult to force the connector members together.

U.S. Pat. No. 4,074,926 shows a high-voltage electrical connector having variously angled tapered resilient interfacing surfaces which create an "interference fit" in an effort to eliminate trapped air and create a tight seal. It would seem that air could still be entrapped since there is no escape route for the air after the tapered surfaces contact each other.

There is a need for a tight-fitting sealed high-voltage cable plug which releases air during connection and disconnection, while being easy to connect and simple to manufacture.

DISCLOSURE OF THE INVENTION

The present invention utilizes a high-voltage cable plug and receptacle having a series of mutually engaging overlapping sleeves creating, in a short plug, a long path from the contact to the ground with a number of air-tight seals to help prevent arcing. An outer sleeve on the plug has a protruding sealing bead around the inside edge of the outer sleeve which engages a mating groove on the receptacle to provide an air-tight seal. A notch in the sealing bead permits interfacial air to escape through the notch while inserting and witdrawing the plug. After connection the groove on the receptacle covers the notch to create an air-tight seal between the outer sleeve and the receptacle. The release of the air creates a partial vacuum inside the cable plug and receptacle insuring a tight connection and eliminating arcing. The partial vacuum would make the cable plug difficult to disconnect, but air enters the notch during disconnection as soon as the notch clears the groove to release the vacuum and allow relatively easy extraction of the cable plug from the receptacle.

A primary receptacle sleeve is provided with an interior truncated conical opening wider at the open end opposite the base of the receptacle, with a protruding secondary receptacle sleeve extending from the interior base of the interior conical opening. A primary plug sleeve has an exterior surface in the shape of a truncated cone mating that of the interior conical opening of the receptacle. The primary plug sleeve is inserted within the primary receptacle sleeve with a tight friction fit, the distal end of the primary plug sleeve contacting the interior base of the primary receptacle sleeve creating an air-tight seal against the base of the primary receptacle sleeve, with the distal tip of the primary plug sleeve encircling the secondary receptacle sleeve with a tight friction fit creating a second air-tight seal therebetween. A pin within the plug sleeve is, at the same time, inserted within the secondary receptacle sleeve with a tight friction fit creating a third air-tight seal, wherein the pin engages a contact surface within the secondary receptacle sleeve to create the electrical connection. A metal threaded contact post or a solder cup, electrically connected to the receptacle contact, extends from the base of the receptacle and allows electrical connection to the high voltage equipment being powered.

The primary receptacle sleeve is provided with an external perpendicularly protruding ridge encircling the primary receptacle sleeve at a point approximately one-third the distance between the primary receptacle opening and the receptacle base. An exterior truncated conical surface extends from the primary receptacle opening to the protruding ridge, the exterior truncated conical surface being wider at the protruding ridge, with the receptacle groove encircling the exterior truncated conical surface adjacent to the ridge. The outer plug sleeve extends from the base of the plug a length equal to the length of the exterior truncated conical surface of the receptacle, so that when the outer plug sleeve encircles the exterior truncated conical surface of the receptacle, the distal end of the receptacle engages the base of the plug creating a fourth air-tight seal. As the outer sleeve of the plug slides onto the exterior truncated conical surface of the receptacle the sealing bead contacts the exterior conical surface of the receptacle while the notch in the sealing bead permits interfacial air to escape through the notch. When the protruding interior sealing bead on the outer sleeve of the plug engages the mating groove on the receptacle to provide a fifth air-tight seal, the notch is covered by the groove and no more air escapes.

The exterior of the base of the plug is provided with a metal cable shield plate which is the ground connection to the cable shield. Because of the interconnecting sleeves of the plug and receptacle, and the seals therebetween, a long path is created between the internal pin/contact electrical connection and the external cable shield plate ground.

A metal cylinder with internal screw threads and an annular end flange inwardly extending from the cylinder slides over the receptacle and engages the receptacle ridge with the annular end flange pressing against the receptacle ridge. An internally protruding tab in the cylinder adjacent to the annular end flange engages a notch on the perimeter of the receptacle ridge so that there will be no relative motion between the metal cylinder and the receptacle ridge. External threads on the base end of the receptacle receive a plastic nut to secure the cylinder against the receptacle ridge and mount the receptacle to the panel of the high voltage equipment. A flat on the external receptacle threads enables the receptacle to be held securely while the plastic nut is screwed on. Radial grooves around the end face of the plastic nut allow air to escape and oil to flow into the threads thereby displacing any residual air and providing a tight connection as described in U.S. Pat. No. 4,773,871.

Having a large metal split coupling nut allows assembly after the cable is installed by connecting the cable plug to the receptacle and then slipping the split coupling nut over the cable through the split in the coupling nut and screwing the externally threaded coupling nut onto the internally threaded metal cylinder with the split coupling nut engaging the cable shield plate, thereby securing the cable plug to the receptacle and forming a large cross-sectional area to terminate the cable shield to ground.

A cone-shaped bend relief between the cable plug and the cable, tapering from wider at the cable plug to narrower at the cable, ensures that the cable will not be bent and will not break at the critical connecting point where the cable connects to the cable plug despite the bending experienced by the cable plug.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 2:
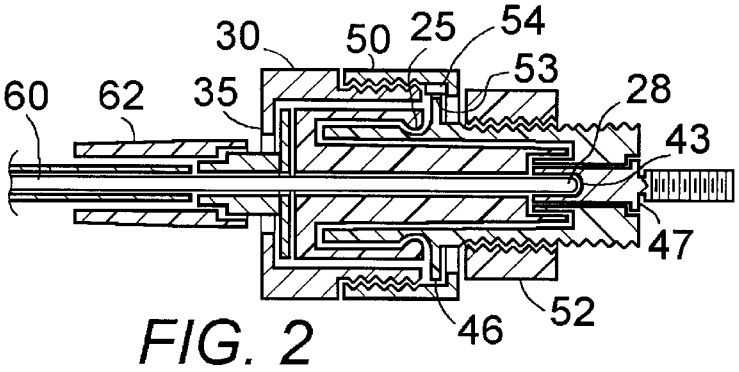
FIG. 2 is a cross-sectional view taken through the centerline of the assembled cable plug and receptacle.
Figure 1:
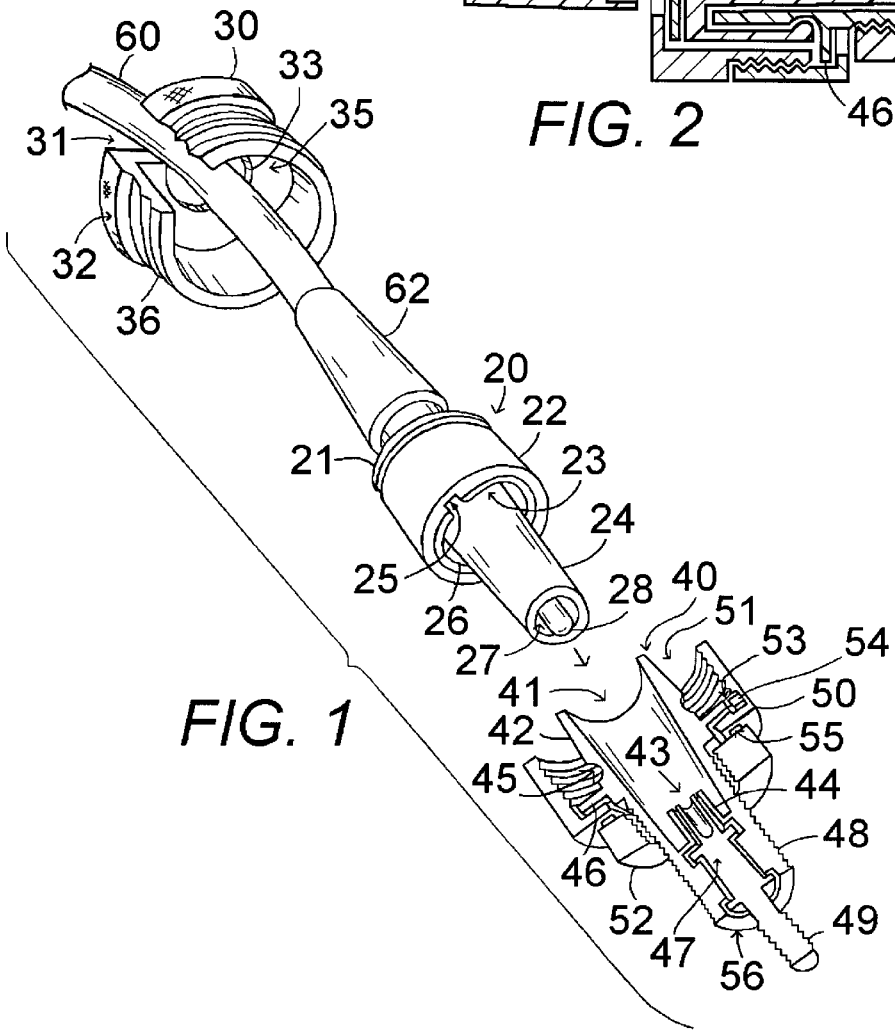
FIG. 1 is a broken perspective view in partial section of the cable plug and cable plug receptacle and their components aligned for connection.

In FIGS. 1 and 2, the invention comprises a high-voltage cable plug 20 and plug receptacle 40 with a vented seal therebetween for electrically connecting a high voltage cable 60 to a piece of high voltage equipment (not shown).

The high-voltage cable plug 20 is electrically connected to an end of the high voltage cable 60, the cable plug 20 having a first electrical connecting means in the form of a pin 28 and having an outer sleeve 22 with an air venting means (a notch 25) in a first air sealing means (a protruding sealing ridge 26) around the interior edge of the outer sleeve 22.

The high-voltage cable plug receptacle 40 is electrically connectable to the piece of high voltage equipment by an electrical equipment connection means in the form of an electrically conductive metal post 49 with screw threads from the base of the plug receptacle. The plug receptacle 40 has a second electrical connecting means in the form of a secondary receptacle sleeve 44 for removably mating with the first electrical connecting means, the pin 28, and a second air sealing means, a sealing groove 45, for mating with the first air sealing means, the sealing ridge 26, and sealing the air venting means, the ridge notch 25.

Figure 3:
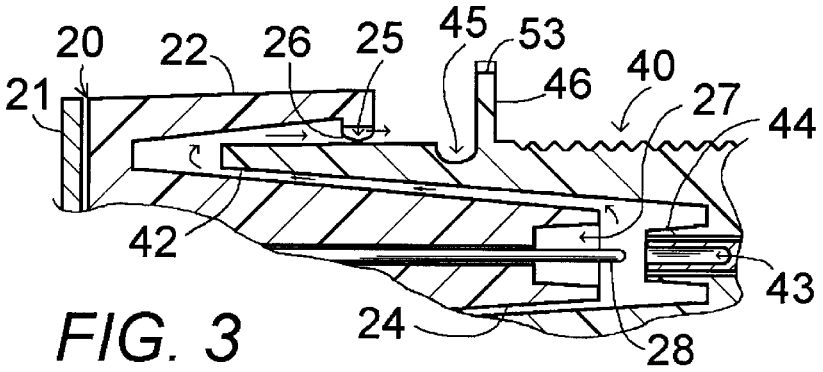
FIG. 3 is a partial cross-sectional view taken through the centerline of the invention showing the cable plug being inserted in the cable plug receptacle.

In FIG. 3, air (arrows) passes through the air venting means, the ridge notch 25, during insertion of the cable plug 20 into the cable plug receptacle 40, thereby removing interfacial air between the cable plug 20 and the cable plug receptacle 40, and air passes through the air venting means during disconnection of the cable plug from the plug receptacle, admitting air therebetween to make the disconnection easier.

Figure 4:
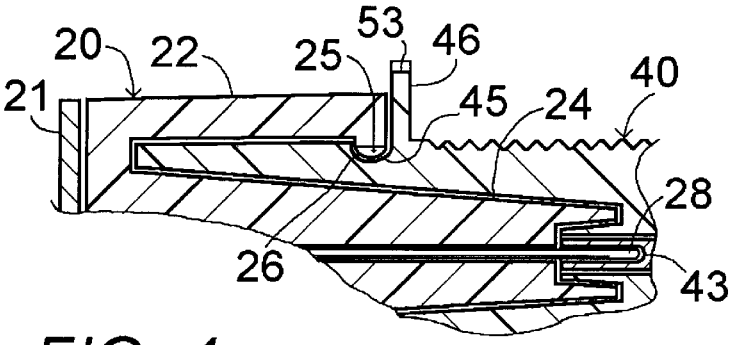
FIG. 4 is a partial cross-sectional view taken through the centerline of the invention showing the cable plug filly connected to the cable plug receptacle.

In FIG. 4, with the cable plug 20 and plug receptacle 40 fully connected a first air-tight seal is created between the first air sealing means, the sealing ridge 26, and the second air sealing means, the sealing groove 45 and no air passes through the air venting means, the ridge notch 25, the notch depth being less than the depth of the sealing groove.

The cable plug 20 and the cable plug receptacle 40 have a series of mutually engaging overlapping sleeves therebetween creating additional air-tight seals therebetween.

The cable plug receptacle 40 has a primary receptacle sleeve 42 having an interior truncated conical opening 41, wider at a distal open end opposite a proximal closed end having a receptacle base. The cable plug 20 has a primary plug sleeve 24 having an exterior surface in the shape of a truncated cone configured to mate with the interior truncated conical opening of the receptacle, so that the primary plug sleeve 24 is removably insertable within the primary receptacle sleeve 42 with a tight friction fit with a distal end of the primary plug sleeve contacting the receptacle base inside the primary receptacle sleeve, thereby creating a second air-tight seal therebetween.

The secondary receptacle sleeve 44 of the cable receptacle extends from the receptacle base in the interior truncated conical opening 41, the secondary receptacle sleeve 44 configured to mate with the interior opening 27 in the primary plug sleeve 24, so that the secondary receptacle sleeve 44 is reversibly insertable within the distal tip of the primary plug sleeve 24 with a tight friction fit creating a third air-tight seal therebetween.

The secondary receptacle sleeve 44 has an opening 43 into an interior electrically conductive contact surface 47 electrically connected to the electrical equipment connection means, the post 49. The interior contact surface opening 43 is configured to mate with the plug pin 28, so that the pin is removably insertable within the secondary receptacle sleeve with a tight friction fit making an electrical connection with the contact surface in the secondary receptacle sleeve.

The primary receptacle sleeve 42 further comprises an external perpendicularly protruding ridge 46 encircling the primary receptacle sleeve at a point between the primary receptacle opening and the receptacle base. A receptacle exterior truncated conical surface extends from the primary receptacle opening to the protruding ridge, the receptacle exterior truncated conical surface being wider at the protruding ridge and having the sealing groove 25 encircling the exterior truncated conical surface adjacent to the ridge 46.

The outer plug sleeve 22 extends from the base of the plug a length equal to the length of the exterior truncated conical surface of the cable plug receptacle, so that the outer plug sleeve 22 covers the cable plug receptacle to the receptacle ridge 46 and the sealing ridge 26 of the cable plug engages the sealing groove 45 of the cable plug receptacle when the two are fully engaged as in FIG. 4.

A metal cable shield plate 21 is connected to the cable plug on an exterior of the cable plug base, the shield plate comprising the ground connection to the plug, so that a long path is created by the series of mutually engaging overlapping sleeves between the internal pin/contact electrical connection and the external cable shield plate ground.

Figure 5:
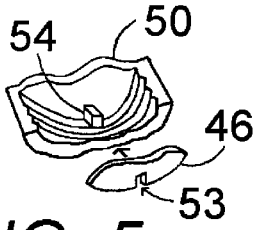
FIG. 5 is a broken perspective view in partial section showing a protruding tab in the receptacle metal sleeve aligned to engage the ridge notch in the receptacle ridge.

In FIGS. 1, 2, and 5, a metal cylinder 50 removably encircles and engages the receptacle ridge 46, the metal cylinder having internal screw threads and an annular end flange inwardly extending from the cylinder, the annular end flange pressing against the receptacle ridge 46. The metal cylinder 50 has an internally protruding tab 54 in the cylinder adjacent to the annular end flange, and the receptacle ridge 46 is provided with a ridge notch 53 in its perimeter, so that the protruding tab 54 engages the ridge notch 53 to prevent relative motion between the metal cylinder and the receptacle ridge.

The receptacle 40 further comprises external threads 48 on the base end of the receptacle and a plastic nut 52 screwed onto the external receptacle threads to secure the cylinder 50 against the receptacle ridge 46, the external receptacle threads having a flat 56 on the threads to enable the receptacle to be held securely by the panel of the high voltage equipment while the plastic nut 52 is screwed on.

Figure 6:
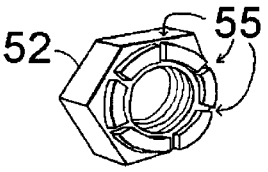
FIG. 6 is a perspective view of the plastic nut of the receptacle showing the radial grooves on the face of the nut.

In FIG. 6, the plastic nut 52 is provided with radial grooves 55 around an end face of the plastic nut to allow air to escape between the mated threads and between the mounting surfaces of the high voltage equipment and the plastic nut 52, thereby providing a tight connection.

The cable plug 20 further comprises a metal coupling nut 30 having external threads 36 configured to screw into the metal cylinder 50 and is provided with a split 31 through a portion of the metal coupling nut, the split sized to fit the cable 60 therethrough. The split metal coupling nut 30 allows assembly after the cable is installed by connecting the cable plug 20 to the cable plug receptacle 40 and then slipping the split coupling nut 30 over the cable 60 through the split 31 in the coupling nut and screwing the externally threaded coupling nut 30 into the internally threaded metal cylinder 50 with an annular cap 33 of the split coupling nut 30 engaging the cable shield plate 21, thereby securing the cable plug 20 to the receptacle 40 and forming a large cross-sectional area to terminate the cable shield to ground. A knurled ring 32 on the outside of the coupling nut allows the nut to be gripped securely.

The cable plug further comprises a cone-shaped bend relief 62 between the cable plug 20 and the cable 60, the bend relief tapering from wider at the cable plug to narrower at the cable to insure that the cable will not be bent and will not break at the critical connecting point where the cable connects to the cable plug.

The electrically conductive components of the device are fabricated of electrically conductive metal and the other components are primarily fabricated of nonconductive plastic and rubberized plastic.

It is understood that the preceding description is given merely by way of illustration and not in limitation of the invention and that various modifications may be made thereto without departing from the spirit of the invention as claimed.

What is claimed is:

1. A high-voltage cable plug and plug receptacle device with a vented seal therebetween for electrically connecting a high voltage cable to a piece of high voltage equipment, wherein the device comprises:

a high-voltage cable plug at an end of the high voltage cable, the cable plug having a first electrical connecting means and an outer sleeve having an air venting means in a first air sealing means;

a high-voltage cable plug receptacle electrically connectable to the piece of high voltage equipment by an electrical equipment connection means, the plug receptacle having a second electrical connecting means for removably mating with the first electrical connecting means and a second air sealing means for mating with the first air sealing means and sealing the air venting means, so that air passes through the air venting means during insertion of the cable plug into the cable plug receptacle, thereby removing interfacial air between the cable plug and the cable plug receptacle, and air passes through the air venting means during disconnection of the cable plug from the plug receptacle, admitting air therebetween to make the disconnection easier, and when the cable plug and plug receptacle are fully connected a first air-tight seal is created between the first and second air sealing means and no air passes through the air venting means, the first and second air sealing means comprising a protruding sealing ridge and a mating sealing groove, positioned with one on the cable plug and the other on the receptacle so that when the cable plug and receptacle are fully connected, the sealing groove engages and covers the sealing ridge and covers the air venting means, and the air venting means comprises the sealing ridge provided with a notch therein, which said notch is covered by the sealing groove when the sealing ridge and sealing groove are mutually engaged.

2. The device of claim 1 wherein the sealing ridge is provided with the notch in its outer surface and the notch depth is less than the depth of the sealing groove.

3. The device of claim 1 wherein the cable plug and the cable plug receptacle have a series of mutually engaging overlapping sleeves therebetween creating additional air-tight seals therebetween.

4. The device of claim 3 wherein the cable plug receptacle further comprises a primary receptacle sleeve having an interior truncated conical opening wider at a distal open end opposite a proximal closed end having a receptacle base, and the cable plug further comprises a primary plug sleeve having an exterior surface in the shape of a truncated cone configured to mate with the interior truncated conical opening of the receptacle, so that the primary plug sleeve is removably insertable within the primary receptacle sleeve with a tight friction fit with a distal end of the primary plug sleeve contacting the receptacle base inside the primary receptacle sleeve creating a second air-tight seal therebetween.

5. The device of claim 4 wherein the cable plug receptacle further comprises a secondary receptacle sleeve extending from the receptacle base in the interior truncated conical opening, the secondary receptacle sleeve configured to mate with the interior of the primary plug sleeve, so that the secondary receptacle sleeve is reversibly insertable within the distal tip of the primary plug sleeve with a tight friction fit creating a third air-tight seal therebetween.

6. The device of claim 5 wherein the first electrical conducting means of the cable plug comprises a pin within the plug sleeve electrically connected to the cable, the pin configured to mate with the interior of the secondary receptacle sleeve, and the secondary receptacle sleeve further comprises an interior contact surface electrically connected to the electrical equipment connection means, the interior contact surface configured to mate with the pin, so that the pin is removably insertable within the secondary receptacle sleeve with a tight friction fit making an electrical connection with the contact.

7. The device of claim 6 wherein the electrical equipment connection means comprises a metal threaded contact post electrically connected to the cable plug receptacle contact surface, extends from the base of the cable plug receptacle and screws into the high voltage equipment being powered.

8. The device of claim 5 wherein the primary receptacle sleeve further comprises an external perpendicularly protruding ridge encircling the primary receptacle sleeve at a point between the primary receptacle opening and the receptacle base, a receptacle exterior truncated conical surface extends from the primary receptacle opening to the protruding ridge, the receptacle exterior truncated conical surface being wider at the protruding ridge and having the sealing groove encircling the exterior truncated conical surface adjacent to the ridge.

9. The device of claim 8 wherein the outer plug sleeve extends from the base of the plug a length equal to the length of the exterior truncated conical surface of the cable plug receptacle and the outer plug sleeve further comprises the sealing ridge extending from an interior edge of the outer plug sleeve adjacent to the outer plug sleeve opening, so that when the outer plug sleeve encircles the exterior truncated conical surface of the cable plug receptacle, the sealing ridge engages the mating groove.

10. The device of claim 5 wherein the cable plug further comprises a metal cable shield plate on an exterior of the cable plug base, the shield plate comprising the ground connection to the plug, so that a long path is created by the series of mutually engaging overlapping sleeves between the internal pin/contact electrical connection and the external cable shield plate ground.

11. The device of claim 10 wherein the cable plug receptacle further comprises a metal cylinder removably encircling and engaging the receptacle ridge, the metal cylinder having internal screw threads and an annular end flange inwardly extending from the cylinder, the annular end flange pressing against the receptacle ridge, the metal cylinder having an internally protruding tab in the cylinder adjacent to the annular end flange, and the receptacle ridge is provided with a ridge notch in its perimeter, so that the protruding tab engages the ridge notch to prevent relative motion between the metal cylinder and the receptacle ridge.

12. The device of claim 11 wherein the receptacle further comprises external threads on the base end of the receptacle and a plastic nut screwed onto the external receptacle threads to secure the cylinder against the receptacle ridge, the external receptacle threads having a flat on the threads to enable the receptacle to be held securely while the plastic nut is screwed on.

13. The device of claim 12 wherein the plastic nut is provided with radial grooves around an end face of the plastic nut to allow air to escape between the mated threads and between the metal mounting surface of the high voltage equipment and the plastic nut, thereby providing a tight connection.

14. The device of claim 11 wherein the cable plug further comprises a metal coupling nut having external threads configured to screw into the metal cylinder and provided with a split through a portion of the metal coupling nut, the split sized to fit the cable therethrough, so that the split metal coupling nut allows assembly after the cable is installed by connecting the cable plug to the cable plug receptacle and then slipping the split coupling nut over the cable through the split in the coupling nut and screwing the externally threaded coupling nut into the internally threaded metal cylinder with the split coupling nut engaging the cable shield plate, thereby securing the cable plug to the receptacle and forming a large cross-sectional area to terminate the cable shield to ground.

15. The device of claim 1 wherein the cable plug further comprises a cone-shaped bend relief between the cable plug and the cable, the bend relief tapering from wider at the cable plug to narrower at the cable to insure that the cable will not be bent and will not break at the critical connecting point where the cable connects to the cable plug.

* * * * *